US008616519B2

(12) United States Patent
Bacon

(10) Patent No.: US 8,616,519 B2
(45) Date of Patent: Dec. 31, 2013

(54) SHORING POST WITH SUPPLEMENTAL BEAM SUPPORT

(75) Inventor: David L. Bacon, Tempe, AZ (US)

(73) Assignee: Titan Formwork Systems, LLC, Tempe, AZ (US)

( * ) Notice: Subject to any disclaimer, the term of this patent is extended or adjusted under 35 U.S.C. 154(b) by 203 days.

(21) Appl. No.: 13/215,701

(22) Filed: Aug. 23, 2011

(65) Prior Publication Data

US 2012/0042600 A1 Feb. 23, 2012

Related U.S. Application Data

(60) Provisional application No. 61/376,043, filed on Aug. 23, 2010.

(51) Int. Cl.
*E04G 25/00* (2006.01)

(52) U.S. Cl.
CPC ..... *E04G 25/00* (2013.01)
USPC ..... 249/18

(58) Field of Classification Search
CPC ..... E04G 11/38
USPC ..... 249/18, 28; 248/357, 351, 351.1, 351.3, 248/351.5, 354.1, 354.3, 354.4, 354.5, 248/354.6, 200.1, 230.1
See application file for complete search history.

(56) References Cited

U.S. PATENT DOCUMENTS

| | | | |
|---|---|---|---|
| 960,151 | A | 5/1910 | Blumenthal |
| 1,241,823 | A | 10/1917 | Couper |
| 1,498,665 | A | 6/1924 | MacIvor |
| 2,445,543 | A | 7/1948 | Thines |
| 2,584,446 | A | 2/1952 | Hastings et al. |
| 2,777,660 | A | 11/1953 | Albrecht |
| 2,902,592 | A | 9/1959 | Cole et al. |
| 3,228,646 | A | 1/1966 | Hinrichs et al. |
| 3,265,346 | A | 8/1966 | Petrick |
| 3,424,111 | A | 1/1969 | Maslow |
| 3,851,856 | A | 12/1974 | Berg |
| 3,870,268 | A | 3/1975 | Larkin |
| 4,238,818 | A | 12/1980 | Gindel |
| 4,408,431 | A | 10/1983 | D'Alessio et al. |
| 4,481,748 | A | 11/1984 | D'Alessio et al. |
| 4,558,893 | A | 12/1985 | Shelly |
| 4,752,057 | A | 6/1988 | Hagemes |
| 4,841,708 | A | 6/1989 | Johnston |
| 5,031,724 | A | 7/1991 | Quinn |
| 5,060,903 | A | 10/1991 | Schwörer |
| 5,240,089 | A | 8/1993 | Spera |

(Continued)

FOREIGN PATENT DOCUMENTS

| | | |
|---|---|---|
| GB | 13348 | 0/1906 |
| GB | 2050465 | 1/1981 |

OTHER PUBLICATIONS

International Search Report Dated Feb. 2, 2012, for PCT/US2011/48791.

*Primary Examiner* — Michael Safavi
(74) *Attorney, Agent, or Firm* — Brinks Gilson & Lione

(57) ABSTRACT

A shoring post having an elongate body with a lengthwise axis, a top and a bottom. A first beam support assembly is at one vertical location on the elongate body, with a second beam support assembly at a second vertical location on the elongate body. The second vertical location is spaced along the lengthwise axis from the first vertical location. The first and second beam support assemblies are configured to support separate load bearing beams.

25 Claims, 11 Drawing Sheets

(56) References Cited

U.S. PATENT DOCUMENTS

| | | | | |
|---|---|---|---|---|
| 5,263,296 | A | 11/1993 | Spera | |
| 5,269,394 | A | 12/1993 | Haroldson, Sr. | 182/113 |
| 5,310,153 | A | 5/1994 | Jackson | |
| 5,317,855 | A | 6/1994 | De Leeuw | |
| 5,379,566 | A | 1/1995 | Schwörer | |
| 5,727,767 | A | 3/1998 | Jefrey | 248/354.3 |
| 6,746,183 | B1 | 6/2004 | Sullivan | |
| 6,913,422 | B2 | 7/2005 | Rogers | 405/272 |
| 7,309,190 | B1 | 12/2007 | Sullivan | |
| 7,530,540 | B2 | 5/2009 | Long et al. | 248/230.1 |
| 7,584,932 | B2 | 9/2009 | Shih | |
| 2003/0194265 | A1 | 10/2003 | Krauss | 403/49 |
| 2007/0264076 | A1 | 11/2007 | McCracken | |
| 2009/0127534 | A1 | 5/2009 | Powell | |

Fig. 1
Prior Art
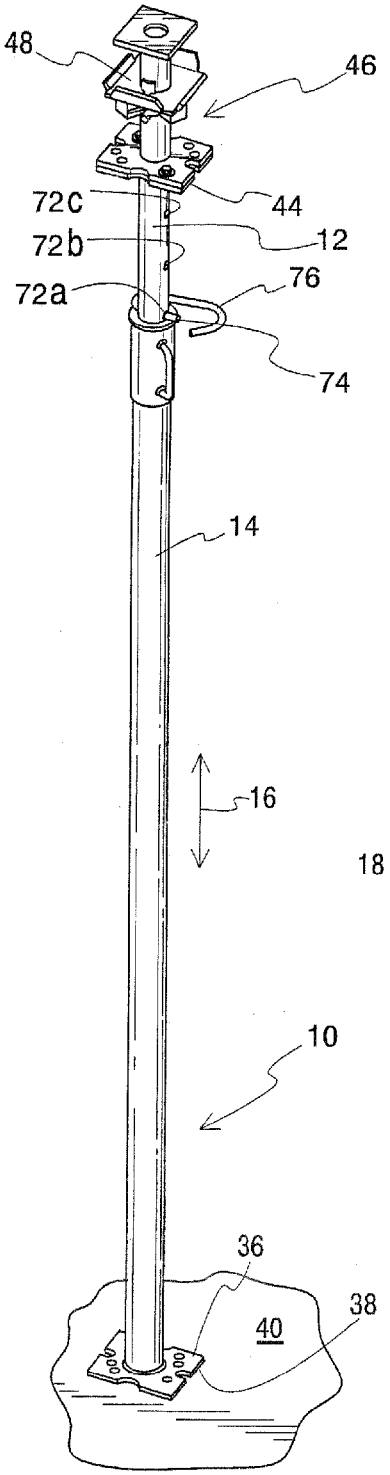
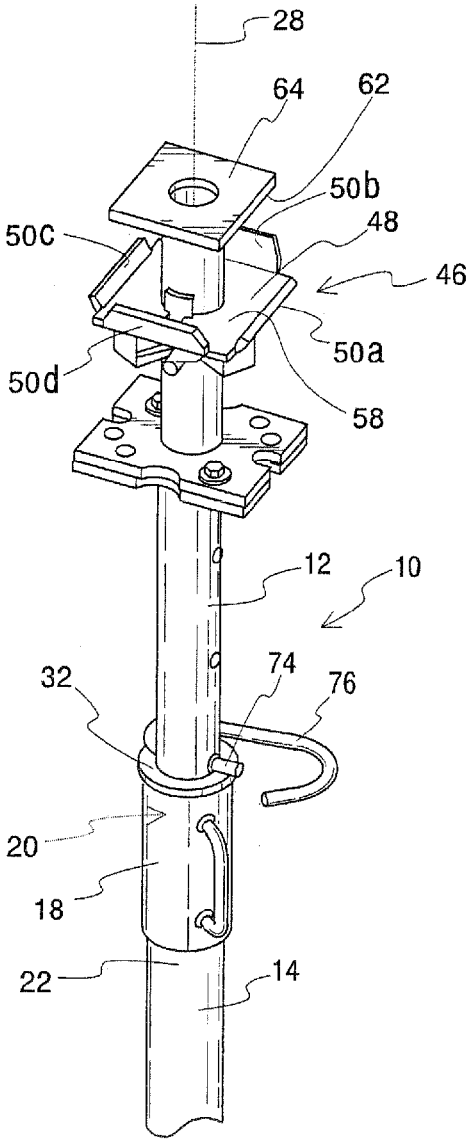
Fig. 2
Prior Art

Fig. 9
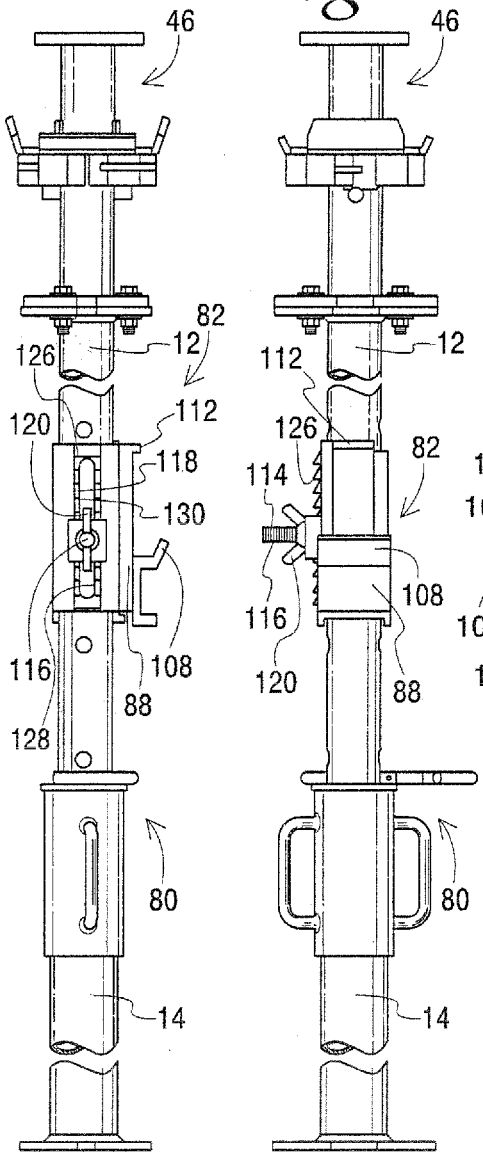
Fig. 8
Fig. 11
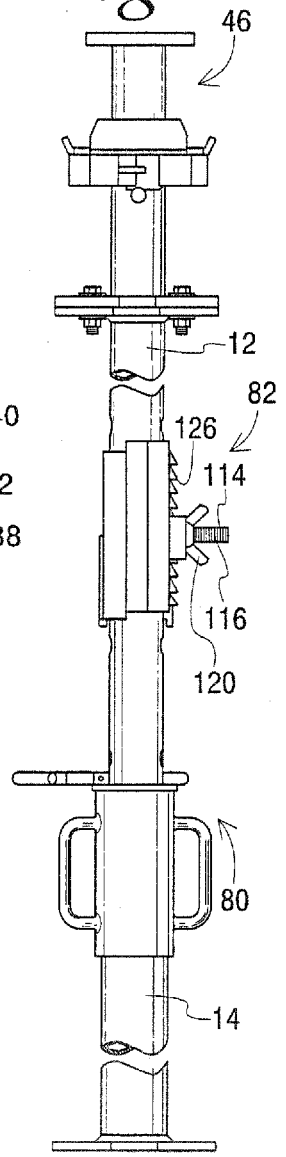
Fig. 10

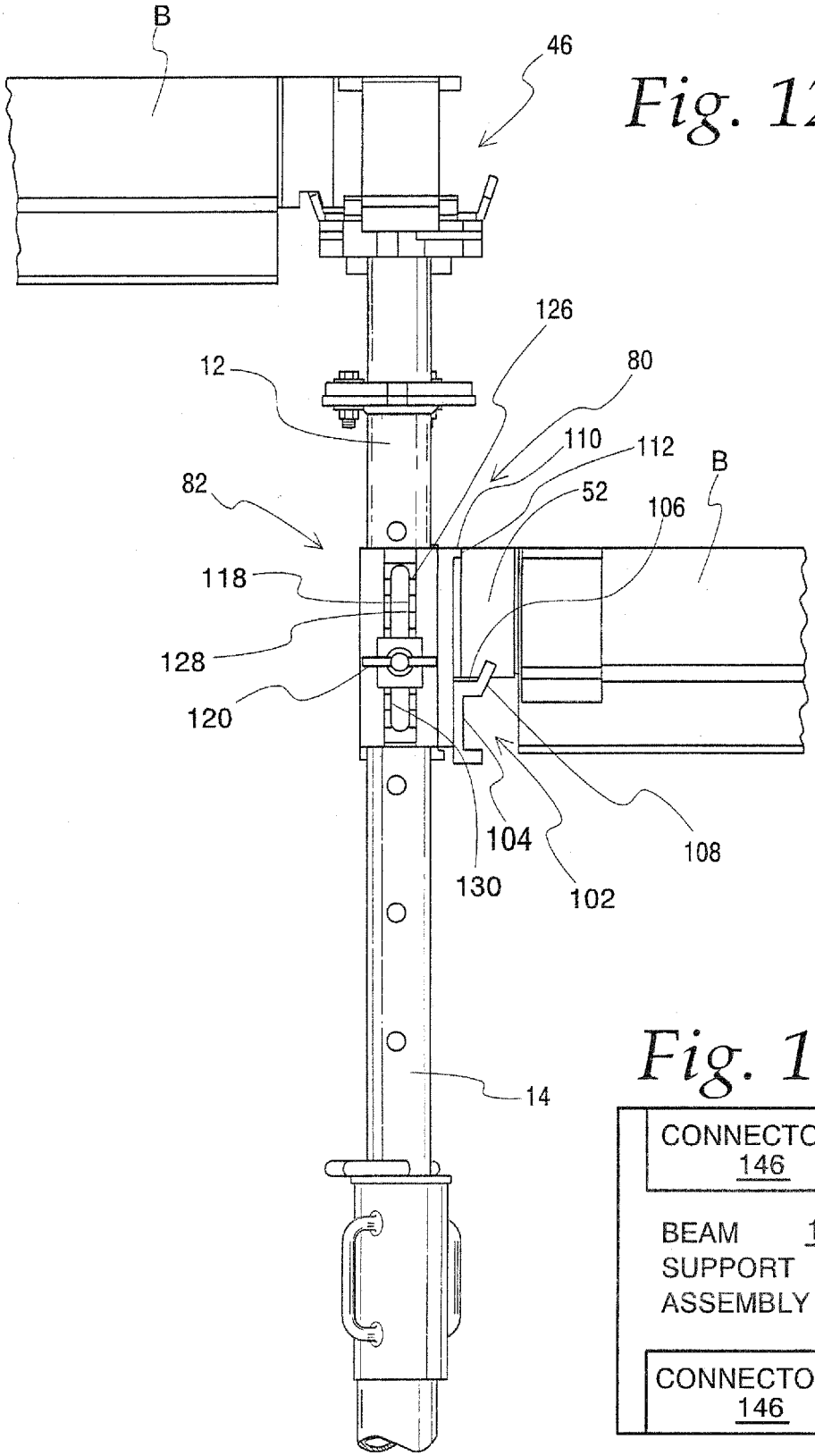
Fig. 12
Fig. 13
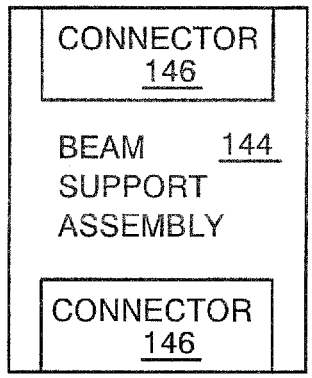

SHORING POST WITH SUPPLEMENTAL BEAM SUPPORT

BACKGROUND OF THE INVENTION

1 Field of the Invention

This invention relates to shoring posts and, more particularly, to a shoring post that is capable of supporting load bearing beams at different heights thereon.

2. Background Art

Shoring posts are used in many diverse environments. Shoring posts are commonly used as components of formwork and in other construction applications.

In a typical shoring post construction, separate post parts are telescopingly engaged, one within the other, to allow a variable combined length to be selected within a predetermined range. A pin is directed through the upper post part and bears upon the lower post part to establish a desired compressive length. Once a gross length is set, supplemental length adjusting structure is utilized to produce the desired compressive force between vertically spaced, facing surfaces between which the shoring post resides. Commonly these supplemental structures are in the form of a threaded jack component, as near the top of the shoring post, and/or a threaded extension sleeve at the bottom post part.

To support one or more load bearing beams using the shoring post, it is known to provide a beam support assembly at the top of the shoring post. Typically, the beam support assembly will consist of a mounting plate with one or more angled flanges to cooperate with a connector at the end of a beam to be supported. The connector nests against the mounting plate and cooperates with the flange so as to allow the adaptor to be simply dropped into place and thereby maintained securely in a predetermined position relative to the shoring post.

In an application wherein beams are supported at a constant height, the shoring posts, through the beams, can be interconnected to form a continuous, reinforced network. However, in the event that the beam heights are stepped, as at a soffit location, modifications are made in the assembly that generally increase cost and to a certain extent compromise the overall system integrity.

More particularly, where there is a change in beam height, separate shoring posts with different lengths are commonly placed in closely adjacent relationship but remain unconnected to each other. As a result, there is a break in continuity in the network between the adjacent posts. In other words, the adjacent shoring posts/beams may not effectively laterally reinforce each other, whereby the overall system stability may be compromised.

Additionally, by reason of requiring additional shoring posts, the cost of a particular project may be increased. Additional shoring posts must be transported to and from a site and independently set up. Further, the additional shoring posts obstruct the space beneath the beams, thereby potentially interfering with the performance of certain tasks on a site within this area.

Heretofore, the construction industry has contended with the above problems since no commercial product has been offered that would address the noted concerns without compromising the integrity of the overall supporting network.

SUMMARY OF THE INVENTION

In one form, the invention is directed to a shoring post including: an elongate body having a lengthwise axis, a top and a bottom; a first beam support assembly at one vertical location on the elongate body; and a second beam support assembly at a second vertical location on the elongate body. The second vertical location is spaced along the lengthwise axis from the first vertical location. The first and second beam support assemblies are configured to support separate load bearing beams.

In one form, the shoring post is provided in combination with a beam having a first connector. The second beam support assembly has a second connector to which the first connector is joined through a press fit step to operatively situate the beam.

In one form, the second beam support assembly includes joinable first and second parts that when joined in operative relationship captively engage the elongate body.

In one form, the second beam support assembly includes a connector for a connector on a beam to be operatively situated on the second beam support assembly.

In one form, the body has a first opening and the second beam support assembly further includes a fastener that extends into the first opening and maintains the first and second parts in operative relationship.

In one form, the first and second parts are selectively joinable in first and second different operative relationships with the fastener extended into the first opening. The first connector is located at different locations along the lengthwise axis with the first and second parts joined in the first and second different operative relationships.

In one form, there are separate meshing components on the first and second parts and the meshing components are configured to interconnect with the first and second parts in each of the first and second different operative relationships.

In one form, the meshing components are configured to interconnect by relatively moving the first and second parts along a line transversely to the lengthwise axis of the body.

In one form, the second beam support assembly further includes a locking block with a first set of teeth and one of the first and second parts has a second set of teeth against which the first set of teeth is borne with the fastener tightened.

In one form, the one of the first and second parts has a slot that is elongate along the lengthwise axis and the second set of teeth is provided adjacent the elongate slot and extends along the lengthwise axis.

In one form, the elongate slot has spaced edges extending along the lengthwise axis and the second set of teeth is provided at, and extends along the lengthwise axis at, each of the spaced edges.

In one form, the body has a plurality of openings including the first opening. The fastener can be extended selectively through each of the plurality of openings to maintain the first and second parts in operative relationship.

In one form, the second beam support assembly includes another connector like the second connector for a connector on another beam to be operatively situated on the second beam support assembly.

In one form, the first beam support assembly includes a plurality of connectors like the second connector.

In one form, the elongate body includes first and second parts that are slidably engaged with each other for relative repositioning along the lengthwise axis to thereby vary a length of the elongate body.

In one form, the meshing components on each of the first and second parts consist of elongate substantially straight and parallel rails that are spaced along the lengthwise axis.

In one form, the elongate body has a convex outer surface and the first and second parts each includes a body with an inside surface with a curvature matched to the convex outer surface.

In one form, the first and second parts cooperatively extend substantially fully around the convex outer surface.

In one form, the shoring post is provided in combination with a first beam operatively situated on the first beam support assembly and a second beam operatively situated on the second beam support assembly.

In one form, the fastener is configured to be hand tightened without requiring any tools to maintain the first and second parts in the operative relationship.

In one form, there is a slot on one of the first and second parts and a tab on the other of the first and second parts, the tab and slot meshing with the first and second parts joined in operative relationship.

In one form, the second beam support assembly includes first and second connectors respectively for first and second connectors on separate beams to be operatively situated on the second beam support assembly.

In one form, the first and second connectors on the second beam support assembly are both on one of the first and second parts.

In one form, there are a plurality of aligned openings in each of the first and second parts through which a fastener can be selectively directed to maintain the first and second parts joined in operative relationship.

BRIEF DESCRIPTION OF THE DRAWINGS

FIG. 1 is a perspective view of a conventional shoring post made up of joinable upper and lower post parts and a pin for maintaining a desired lengthwise relationship between the post parts;

FIG. 2 is an enlarged, fragmentary perspective view of the upper portion of the shoring post in FIG. 1;

FIG. 8 is an elevation view of the inventive shoring post;

FIG. 9 is a view as in FIG. 8 with the shoring post turned 90° from the FIG. 8 position around a vertical axis;

FIG. 10 is a view as in FIG. 9 with the shoring post turned an additional 90°;

FIG. 11 is a view as in FIG. 10 with the shoring post turned an additional 90°;

FIG. 12 is a fragmentary, elevation view of the inventive shoring post supporting two beams at different vertical heights;

FIG. 13 is a schematic representation of a beam support assembly, according to the present invention, for maintaining a plurality of beams at a selected vertical heights on a shoring post;

DETAILED DESCRIPTION OF THE PREFERRED EMBODIMENT

Figure 3:
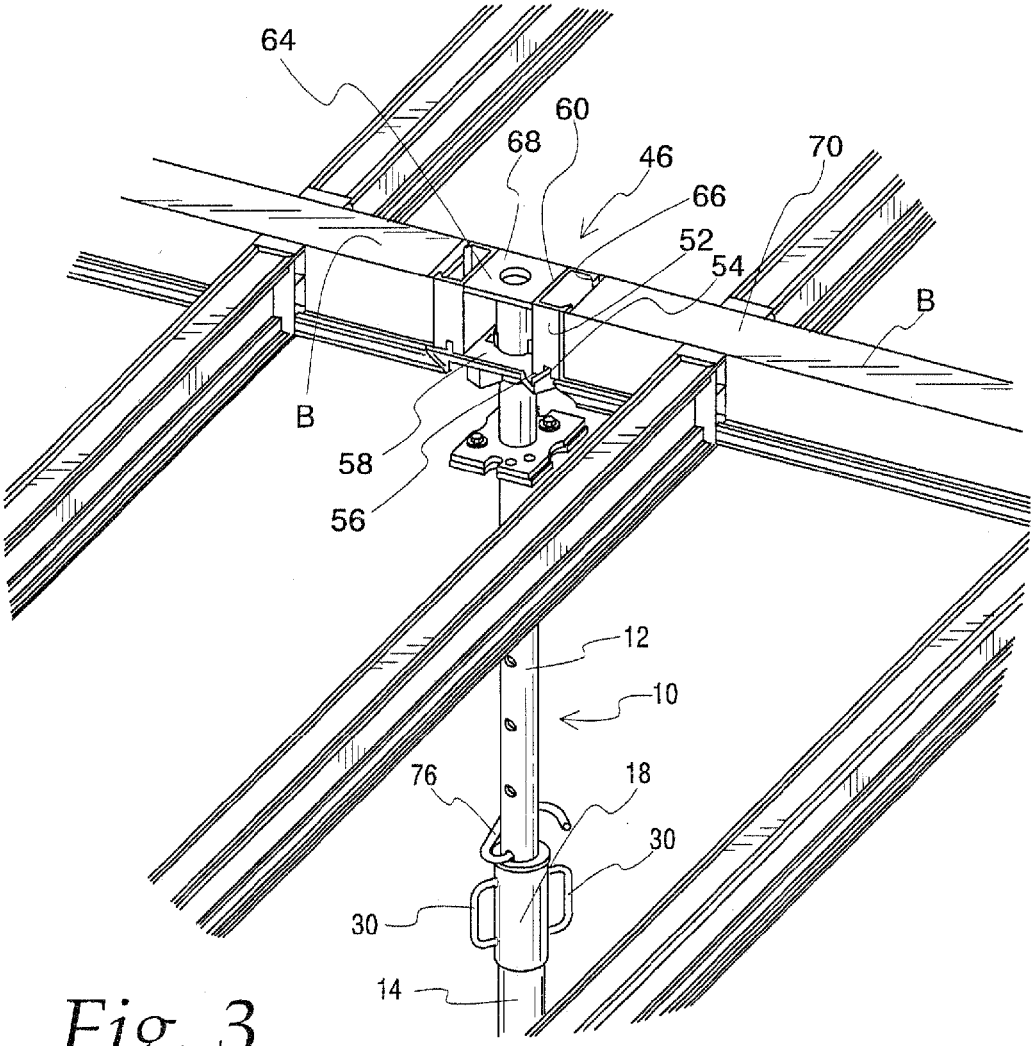
Fig. 3 (Prior Art )
FIG. 3 is an enlarged, fragmentary, perspective view of a beam network with separate beams therein joined to a beam support assembly at the top of a shoring post as shown in FIGS. 1 and 2.

In FIGS. 1-4, a conventional shoring post is shown at 10 with a length adjusting capability. The shoring post 10 consists of a first, upper post part 12 and a second, lower post part 14. The post parts 12, 14 are telescopingly mated to allow the effective overall length of the shoring post 10, as indicated by the double-headed arrow 16, to be selectively varied.

The lower post part 14 includes an extension sleeve 18 that fits over the upper free end 20 of a tubular component 22 making up the post part 14. The tubular component 22 has external threads (not shown) that engage internal threads (not shown) on the extension sleeve 18. By turning the extension sleeve 18 around a vertical, central axis 28 for the shoring post 10, the extension sleeve 18 can be shifted selectively upwardly and downwardly relative to the component 22, depending upon the turning direction. Handles 30 at diametrically opposite locations on the extension sleeve 18 facilitate grasping and turning of the extension sleeve 18.

A washer 32 surrounds the post part 12 and bears upon the extension sleeve 18.

The shoring post 10 has a bottom bearing plate 36 with a downwardly facing surface 38 that bears facially against an underlying surface 40.

The shoring post 10 has an upper bearing plate 44 to which a beam support assembly at 46 is attached. The beam support assembly 46 has a squared mounting plate 48 with integrally formed, angled mounting flanges 50*a*, 50*b*, 50*c*, 50*d*, located one each at the four peripheral side edges of the square mounting plate 48. Each of the mounting flanges 50 defines, in conjunction with the mounting plate 48, part of a connector to cooperate with a connector 52 at the end of a load bearing beam B, typically an I-beam, to be operatively situated upon the beam support assembly 46, as shown in FIG. 3.

The connector 52 has a slot 54 to accept one of the flanges 50. With the exemplary mounting flange 50*a* in the slot 54 on the connector 52, a bottom edge 56 on the connector 52 bears upon an upwardly facing surface 58 on the mounting plate 48. The angled arrangement of the mounting flanges 50 requires that the connector 52 shift towards the axis 28 as the connector 52 is lowered onto the mounting flange 50*a*. Once fully seated, an upper surface 60 on the connector 52 abuts to an edge 62 on a spacer plate 64. This edge 62, in conjunction with the mounting flange 50*a* and mounting plate 48, makes up one of the four aforementioned connectors capable of cooperating with the connector 52. In the fully seated position for the connector 52, a top edge 66 on the connector 52 is substantially flush with the top surface 68 of the spacer plate 64 and also with the top surface 70 of the associated beam B.

As shown in FIG. 3, multiple beams B can be operatively situated on the beam support assembly 46. With the particular configuration shown, from one to four beams are capable of being simultaneously supported so that the top surfaces thereon are coplanar.

To assemble the shoring post 10, the post parts 12, 14 are shifted guidingly relative to each other until the spacing between the bottom surface 38 of the bearing plate 36 and top surface 68 of the spacer plate 64 is nominally matched to a final desired length. In actuality, the length selected is slightly less than the actual desired length. In this relationship, one of, in this case three, vertically spaced openings 72*a*, 72*b*, 72*c* remains exposed above the extension sleeve 18. A leg 74 on a pin 76 is directed through the lowermost of the exposed openings 72. With the leg 74 directed through, in this case the opening 72*a*, the upper post part 12 can be lowered under its weight until the pin leg 74 bears at diametrically opposite locations upon the washer 32. Thereafter, the extension sleeve 18 can be turned around the axis 28 in a direction so as to shift the upper post part 12 upwardly relative to the lower post part 14 to further increase the overall effective length of the shoring post 10.

As seen in FIG. 3, with the beams B supporting a downwardly facing surface in a single plane, the beams B and shoring posts 10 produce a reinforced network. Within the continuous network, successive shoring posts 10 throughout the network are laterally stabilized and reinforced through interconnecting beams B.

Figure 4:
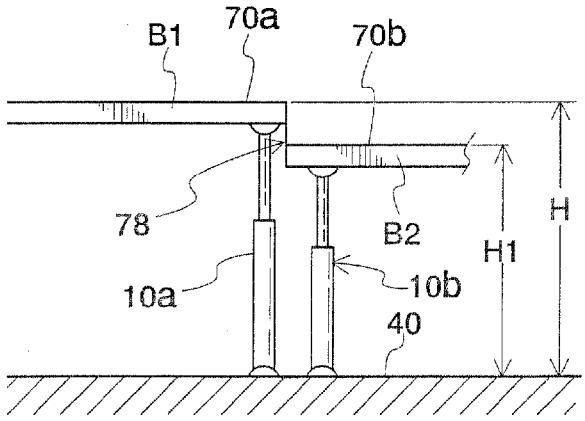
Fig. 4 (Prior Art )
FIG. 4 is a schematic representation of conventional shoring posts in side-by-side relationship to support beams at different vertical heights.
Figure 5:
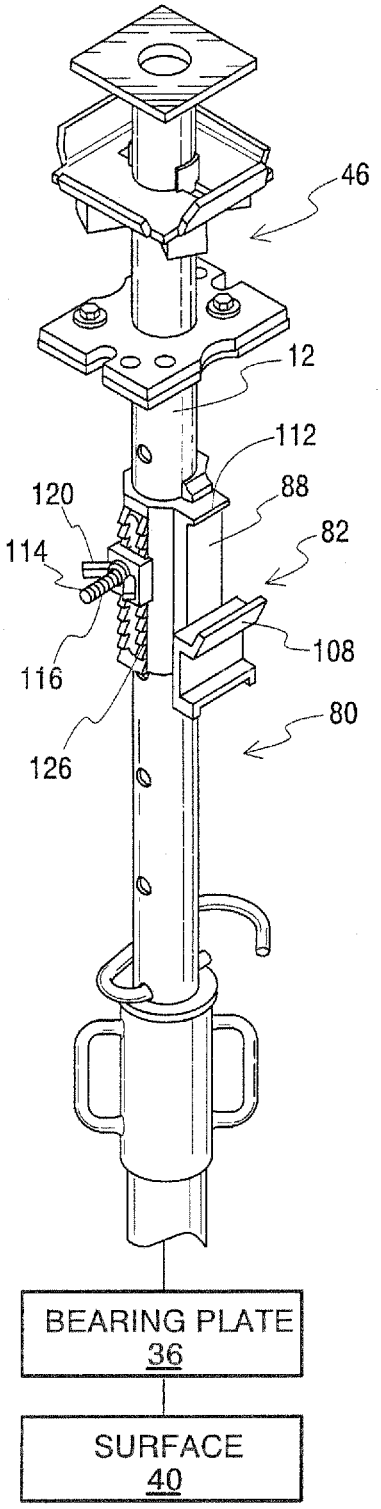
FIG. 5 is a view as in FIG. 2 showing the inventive shoring post with a separate beam support assembly at a different vertical location than the beam support assembly on the shoring post in FIGS. 1-4.
Figure 7:
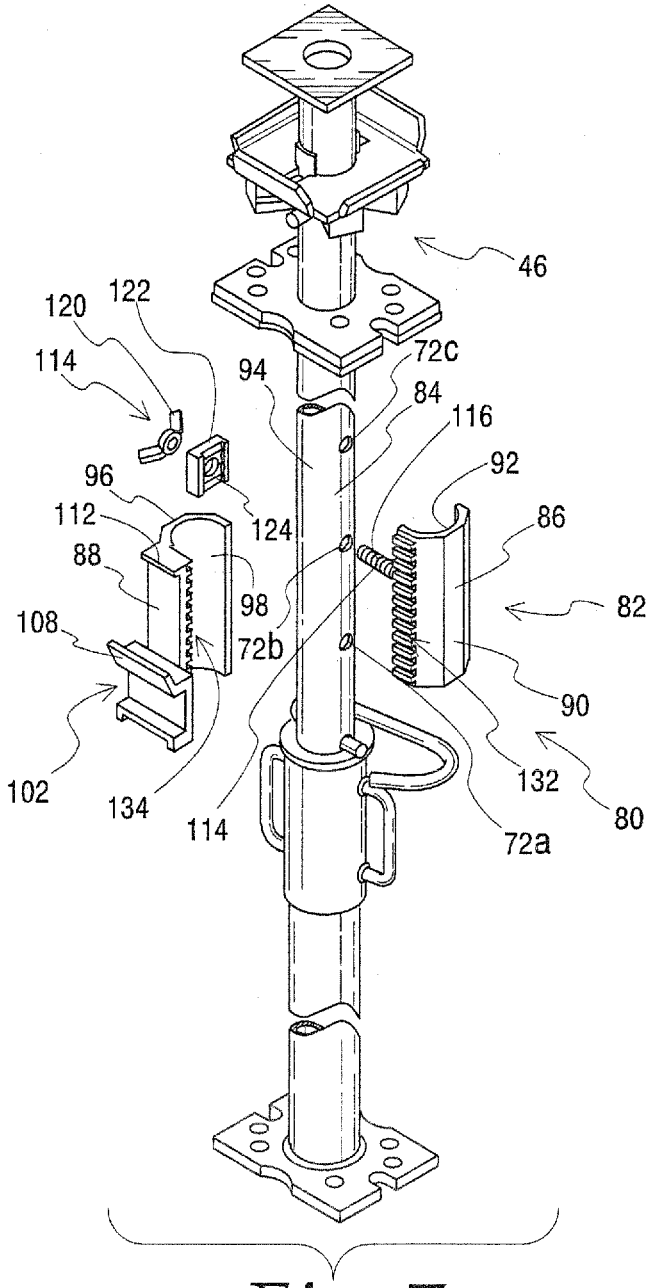
FIG. 7 is an exploded, perspective view of the inventive shoring post in FIG. 5.
Figure 6:
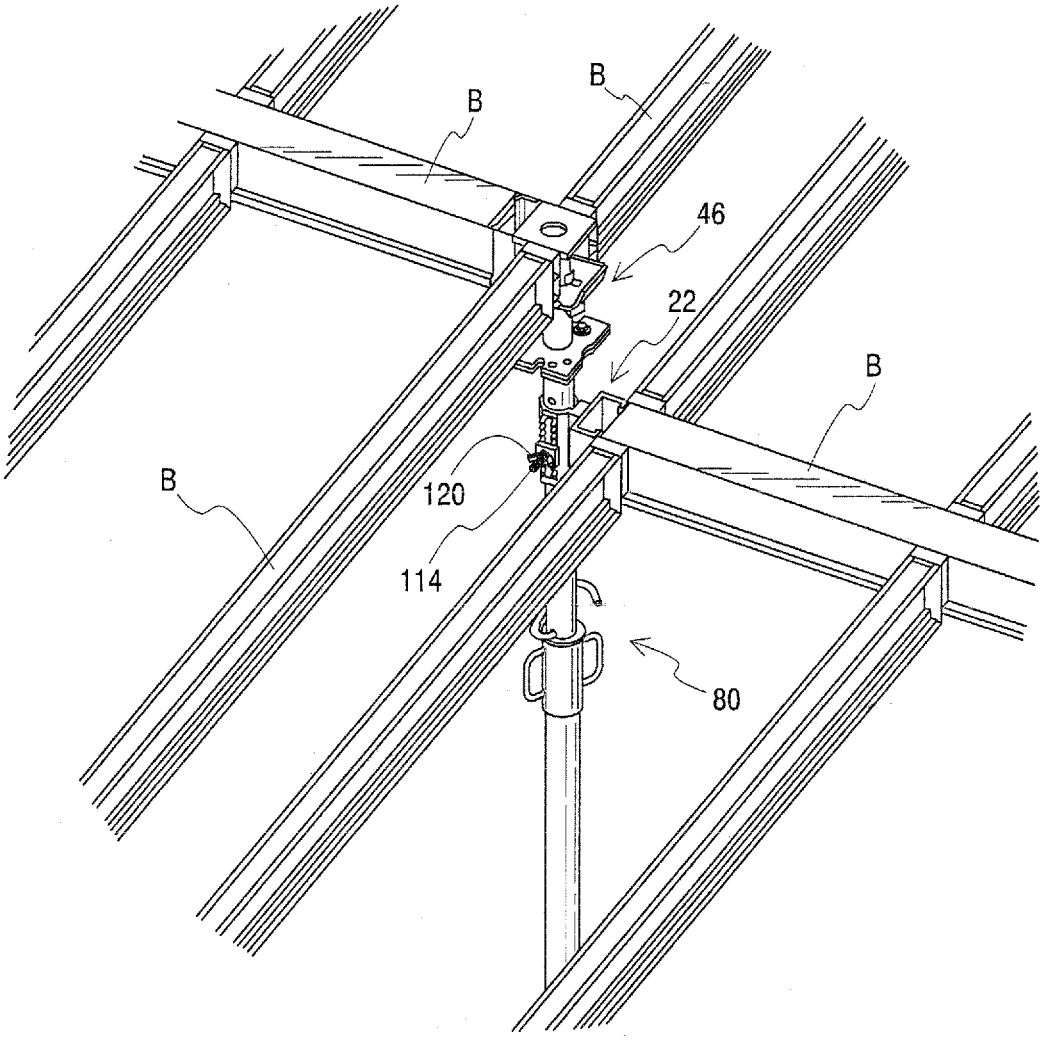
FIG. 6 is a view as in FIG. 3 and showing the inventive shoring post supporting beams in a network at different vertical heights.
Figure 14:
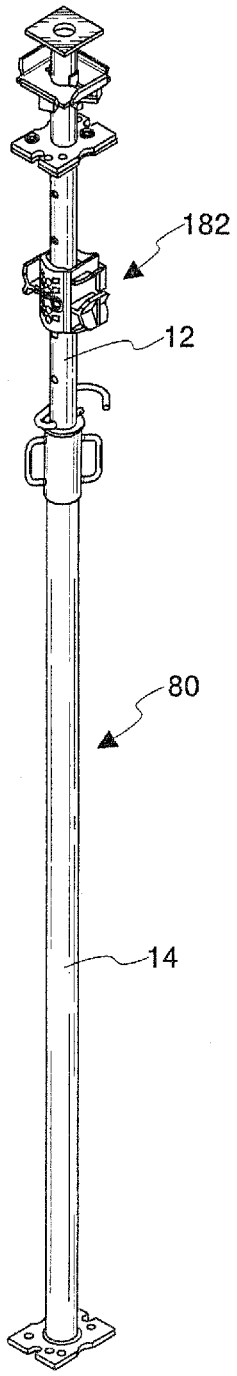
FIG. 14 is a view as in FIG. 1 and showing the inventive shoring post with a modified form of beam support assembly.
Figure 15:
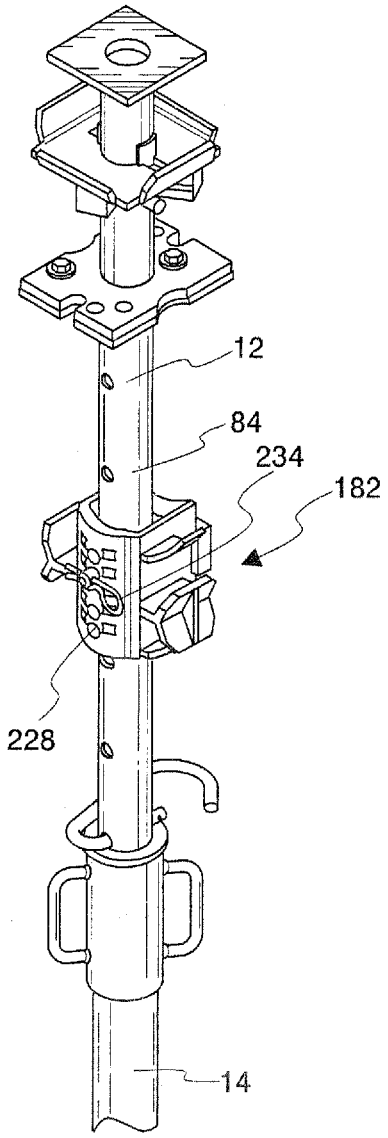
FIG. 15 is an enlarged, perspective view of an upper portion of the shoring post in FIG. 14.
Figure 16:
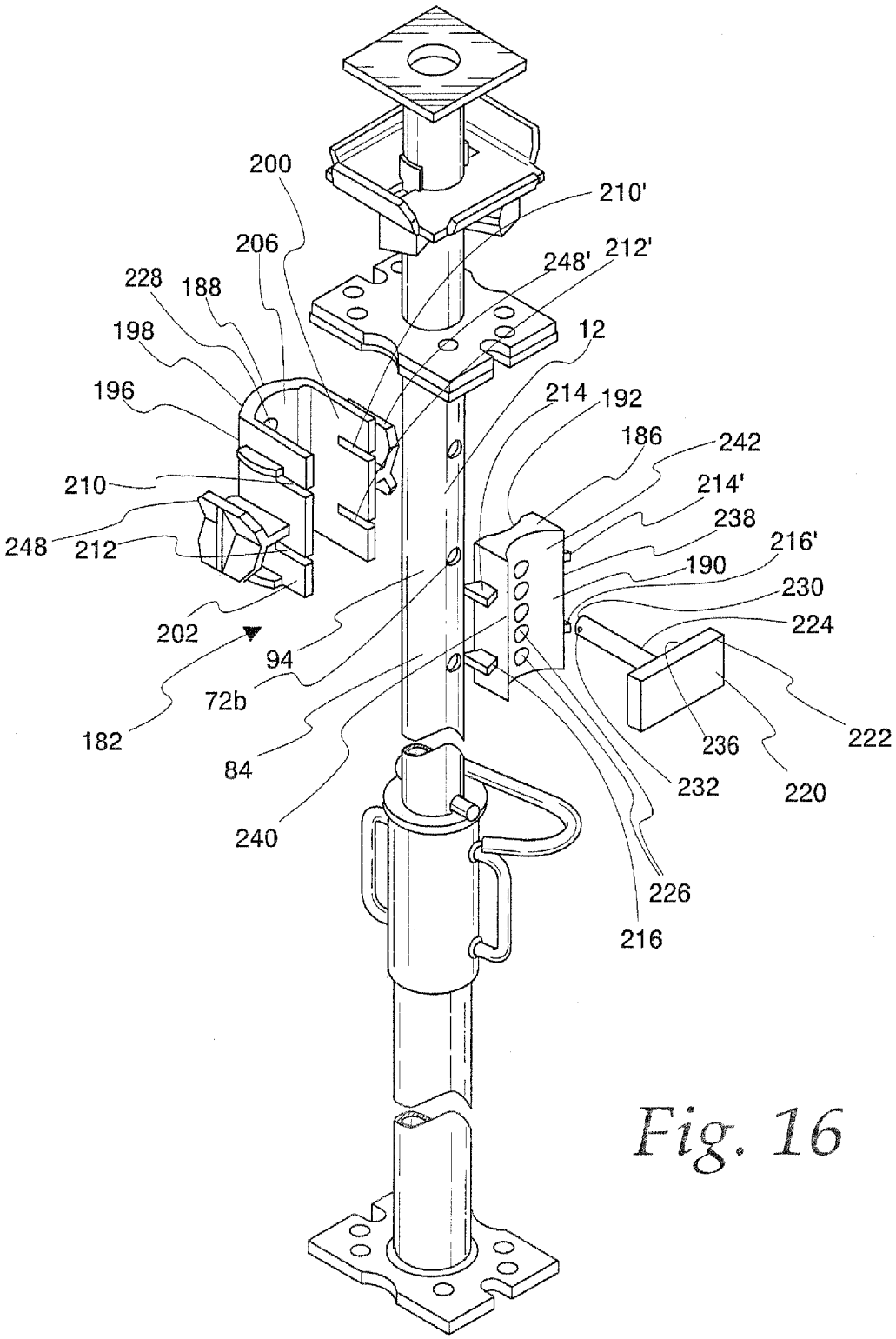
FIG. 16 is a fragmentary, exploded, perspective view of the shoring post in FIG. 15.
Figure 17:
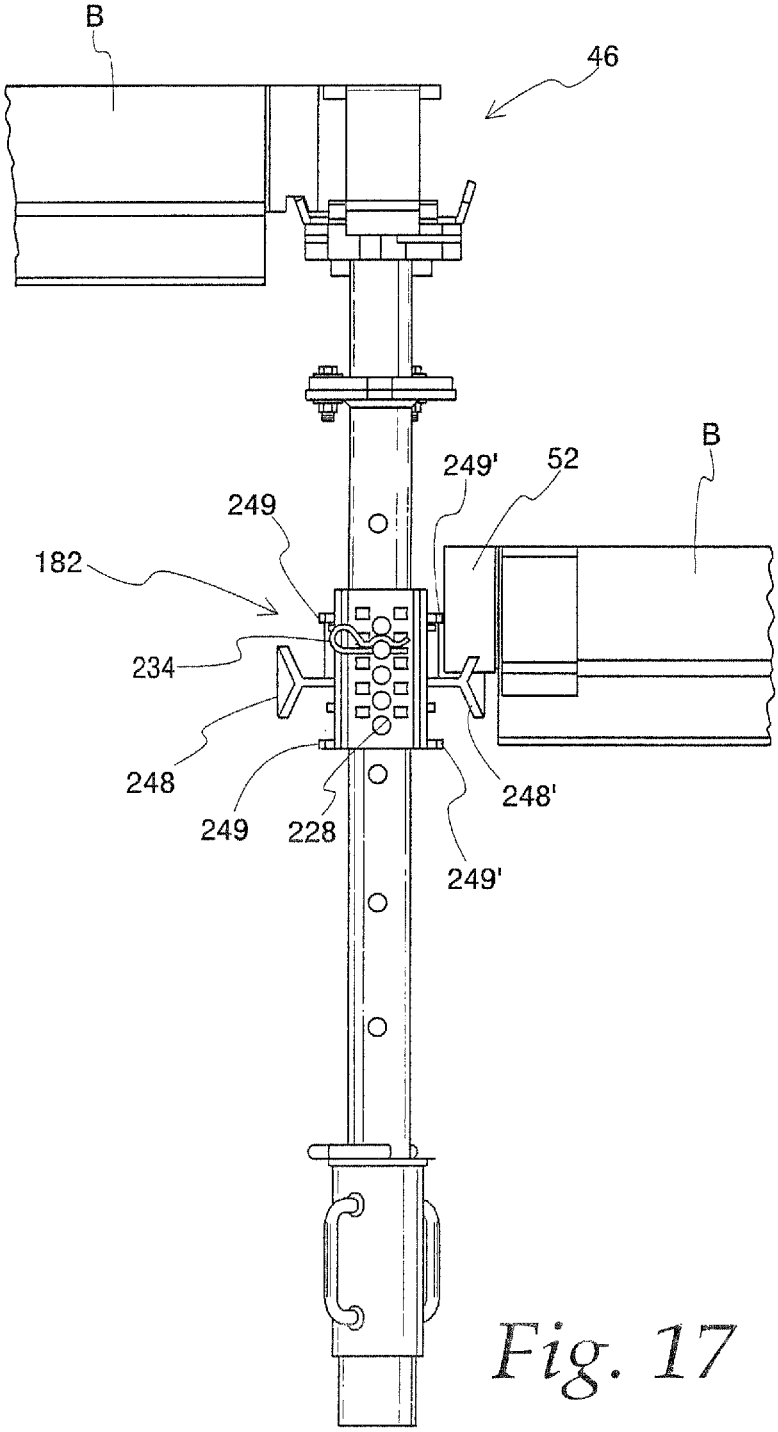
FIG. 17 is a view as in FIG. 12 with the modified form of beam support assembly utilized.
Figure 18:
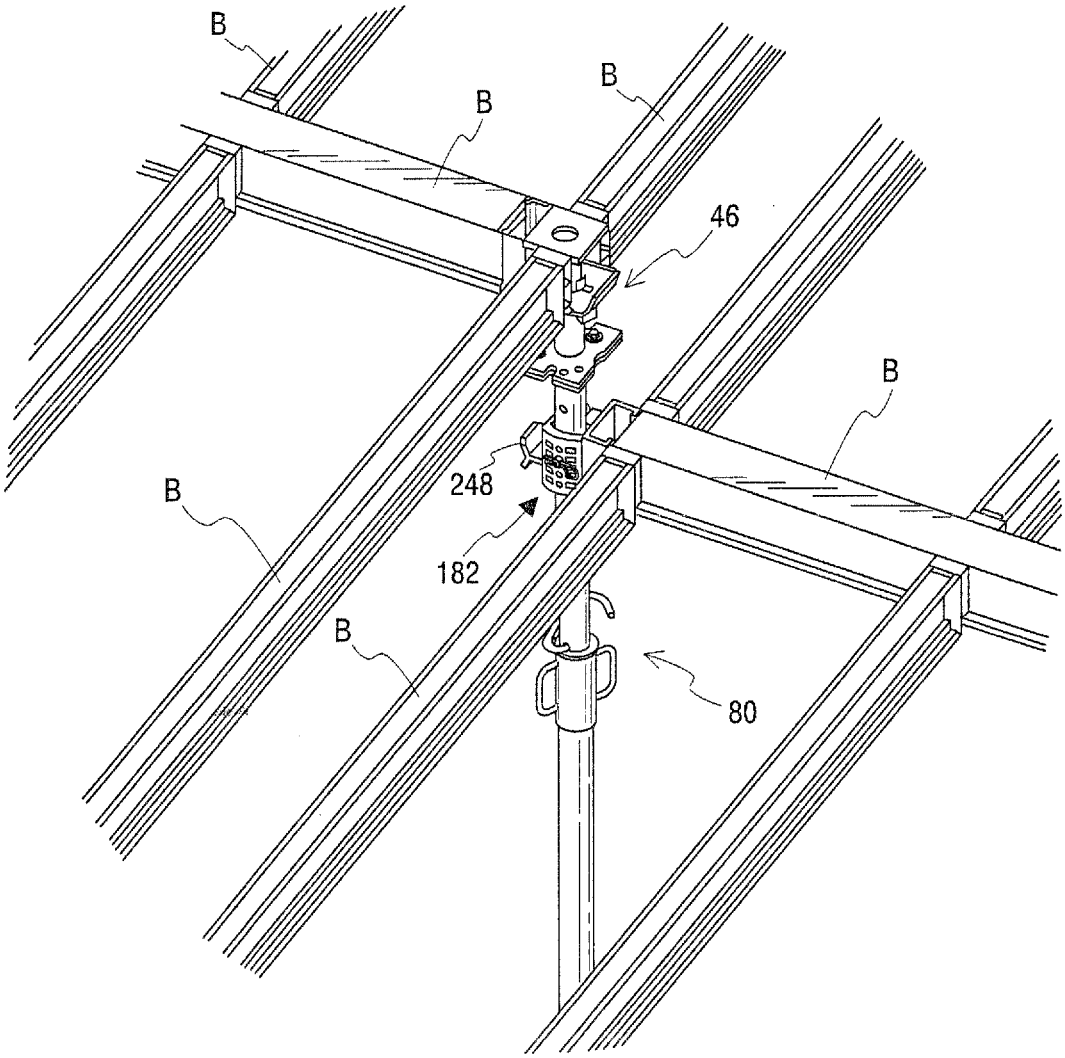
FIG. 18 is a view as in FIG. 6 with a shoring post therein incorporating the modified beam support assembly.
Figure 20:
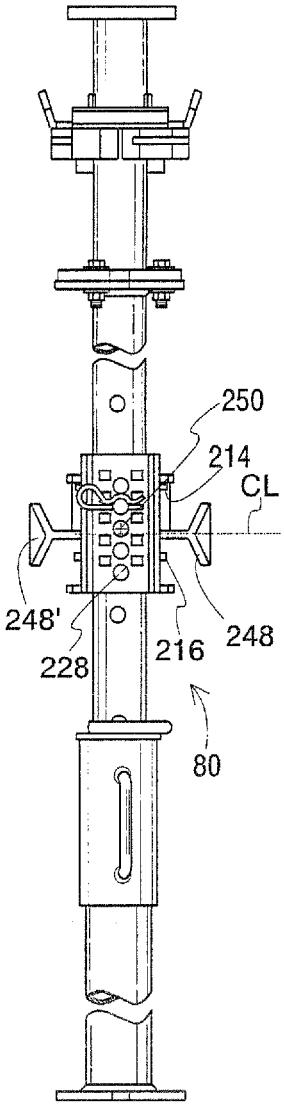
FIG. 20 is a view as in FIG. 19 with the shoring post turned 90° from the FIG. 19 position.
Figure 19:
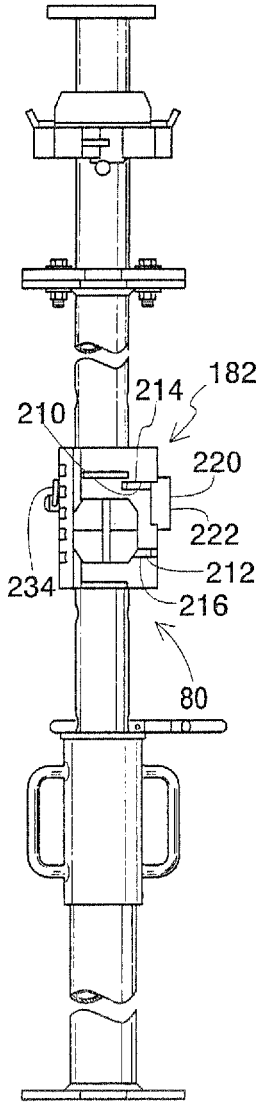
FIG. 19 is an elevation view of the shoring post with the modified form of beam support assembly.
Figure 22:
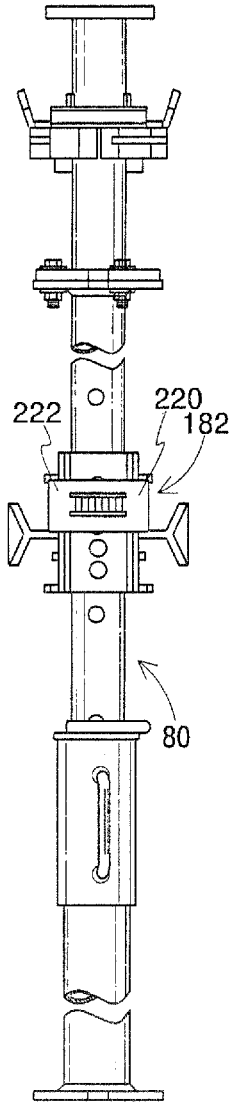
FIG. 22 is a view as in FIG. 21 with the shoring post turned an additional 90°.
Figure 21:
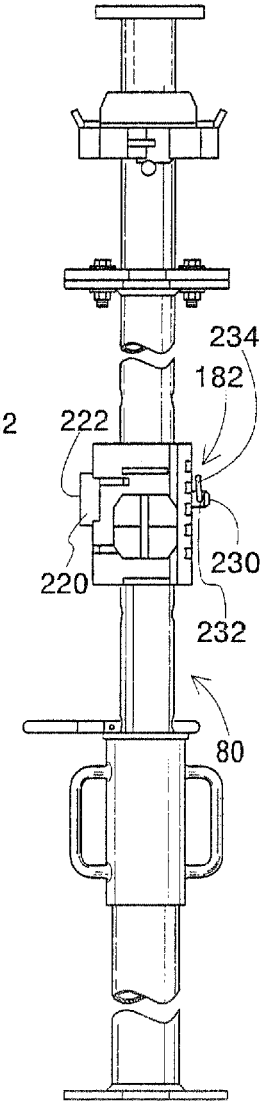
FIG. 21 is a view as in FIG. 20 with the shoring post turned an additional 90°.

As shown in FIG. 4, there may be field conditions, such as at slab and soffit transitions, where vertical support is required at two different heights at adjacent locations. For example, as shown in FIG. 4, at a step location at 78, one shoring post 10*a* is required to support a beam B1 with its top surface 70*a* at a height H above the subjacent surface 40. At an immediately adjacent location, a separate beam B2 is required to have its top surface 70*b* at a height H1 above the surface 40. The height H is greater than the height H1. To accommodate this condition, a separate shoring post 10*b* is placed adjacent to the shoring post 10*a* at the step location 78. As a result, each of the shoring posts 10*a*, 10*b* is independent of the other, with there being no laterally reinforcing connection therebetween. Because of this, the shoring posts 10*a*, 10*b* might shift relative to each other, which could affect the positions of the beams B1, B2 or, in a worst case, cause a dangerous situation wherein one or both of the shoring posts 10*a*, 10*b* might tip.

A shoring post, according to the present invention, is shown at 80 in FIGS. 5-12. The shoring post 80 has the same configuration as the shoring post 10, with the exception that the shoring post 80 incorporates a second beam support assembly at 82 at a vertical location on an elongate body 84, defined cooperatively by the post parts 12, 14, that is below the vertical location at which the beam support assembly 46 resides. As seen most clearly in FIG. 12, the shoring post 80 supports separate beams B, each for bearing a load and typically with an I-beam configuration, at different vertical heights.

The second beam support assembly 82 consists of first and second separate parts 86, 88 that, when joined in operative relationship as shown in FIG. 12, captively engage the elongate body 84. The first part 86 has a body 90 with a curved inside surface 92 that is matched to the curvature of the convex outer surface 94 of the elongate body 84. The second part 88 has a body 96 with an inside surface 98 with a curvature matched to the convex outer surface 94 of the elongate body 84.

With the first and second parts 86, 88 joined in operative relationship, the first and second parts 86, 88 cooperatively extend substantially fully around the convex outer surface 94 of the elongate body 84.

The second part 88 defines a connector 102 that is structurally and functionally like the connectors defined cooperatively by the mounting plate 48, flanges 50, and spacer plate 54. That is, the connector 102 has a wall 104 with a surface 106 corresponding to the surface 58 and a flange 108 corresponding to the flanges 50. A projection 110 defines a wall/edge 112 corresponding to the edge 62.

The aforementioned connector 52 can be press fit to the connector 102 to operatively situate the associated beam B, as shown most clearly in FIG. 12.

To maintain the first and second parts 86, 88 in operative relationship, a fastener 114 is provided. The fastener 114 consists of a threaded shank 116 that is rigidly connected to, or formed with, the body 90 on the first part 86. Of course, the fastener 114 might be entirely separate from the parts 86, 88. The shank 116 is extendable through a selected one of the openings 72*a*, 72*b*, 72*c* in the first part 12 and a slot 118 in the second part 88 that is elongated in a vertical direction. The shank 116 accepts a nut 120, in this case in the form of a wing nut. The wing nut 120 can be tightened by hand without requiring any separate tools to thereby maintain the first and second parts 86, 88 in operative relationship.

To rigidify the connection of the parts 86, 88, a locking block 122 is placed between the nut 120 and second part 88. The locking block has a first set of teeth 124. The teeth are vertically spaced and cooperate with a second set of teeth 126 on the second part 88. By tightening the nut 120, the teeth 124 are moved against the teeth 126 into an interlocking relationship.

The slot 118 has spaced edges 128, 130 extending along the lengthwise axis 28 in generally parallel relationship. The teeth 126 are provided on each of the edges 128, 130. The teeth 124 on the locking block 122 span across the slot 118 to engage the teeth 126 at both edges 128, 130. The teeth 124, 126 interact so that the locking block 122 is keyed against turning movement relative to the second part 88 and also engages the second part 88 over a substantial area that rigidifies the connection of the parts 86, 88 through the fastener 114. This arrangement further diminishes the likelihood that shock and vibrational forces might cause the nut 120 to turn so as to detrimentally loosen.

To join the first and second parts 86, 88 to each other, meshing components 132, 134 are provided on the first and second parts 86, 88, respectively. The meshing components 132 consists of elongate rails 136 spaced at regular vertical intervals so that slots 138 are defined therebetween. The meshing components 134 consists of a similar arrangement of rails 140 and slots 142.

The rails 136, 140 and slots 138, 142 are configured so that the meshing components 132, 134 interconnect by relatively moving the first and second parts 86, 88 along a line generally orthogonal to the lengthwise axis of the elongate body 84. By regularly spacing the rails 136, 140 and slots 138, 142, the rails 136 will move into the slots 142 and the rails 140 will move into the slots 138 and interlock with the first and second parts in different operative relationships that are spaced vertically from each other.

The selected opening 72 into which the threaded shank 116 extends determines the vertical location of the part 86. The slot 118 in the second part 88 will accept the threaded shank 116 with the parts 86, 88 in different vertical relationships representing different operative relationships. By changing the vertical height of the second part 88 relative to the first part 86, the vertical location of the connector 102 is correspondingly changed and can be conveniently selected by a user.

The interconnecting of the rails 136, 140 establishes a positive, keyed connection between the first and second parts 86, 88 that avoids relative vertical movement, or skewing, between the parts 86, 88, thereby to allow positive and rigid support of a beam through the connector 102. To assure that the connector 102 is adequately braced to accept loading, it is preferred that a significant number of the rails 136, 140 intermesh with the selected operative relationship between the first and second parts 86, 88.

Accordingly, with the shoring post 10 in place, the second beam support assembly 82 can be thereafter assembled to incorporate the ability to mount at least one beam at a different vertical location than the vertical location at which a beam is supported by the beam support assembly 46 resides. The user selects a vertical location of the first part 86 by directing the threaded shank 116 through the appropriate opening 72. Thereafter, the second part 88 can be joined to the first part 86 so as to locate the connector 102 at the desired vertical height. The locking block 122 and nut 120 are then assembled and the nut 120 thereafter tightened, as by hand, to maintain the connection of the first and second parts 86, 88 with the connector 102 at the desired height.

As shown schematically in FIG. 13, a beam support assembly 144, generically including the beam support assembly 82, may include multiple connectors 146, corresponding to the connector 102, to accommodate multiple beams B.

With the above-described arrangement, as seen in FIG. 12, the beams B are supported at different heights on the same shoring post 80. Through the same shoring post 80, the beams at the different heights are supported so that a continuous reinforced network of components results without a break therein, as shown with the conventional construction in FIG. 4.

In FIGS. 14-22, a modified form of beam support assembly is shown at 182, corresponding to the beam support assembly at 82, described hereinabove. The beam support assembly 182 is shown incorporated into the shoring post 80 that otherwise has the same components shown in FIGS. 5-12, that function in the described manner. Thus, no description of the remaining components, other than as they cooperate with the beam support assembly 182, is necessary.

The beam support assembly 182 is designed to captively engage the elongate body 84 in the same manner as the beam support assembly 82, and has a first part 186 and a second part 188. The first part 186 has a body 190 with a curved inside surface 192 that is matched to the curvature of the convex outer surface 94 of the elongate body 84 on the post part 12.

The second part 188 has a body 196 that is generally "U"-shaped with a base 198 and spaced legs 200, 202 projecting therefrom. The spacing of the legs 200, 202 is such that they closely straddle the outer surface 94.

The base 188 has a concave surface 206 that is nominally matched to the curvature of the outer surface 94 of the elongate body 84. With the second part 188 in place, the surface 206 abuts to the post surface 94. The first part 186 can then be directed to between the legs 200, 202 until the inside surface 192 abuts to the post surface 94, whereby the elongate body 84 is closely captively located between the surfaces 192, 206.

The beam support assembly parts 186, 188 are keyed together through a meshed tab-and-slot arrangement. More particularly, exemplary leg 202 has horizontal, generally parallel slots 210, 212 formed therein to receive tabs 214, 216, respectively, on the first part 186. Slots 210', 212' are provided on the leg 200 to cooperate with tabs 214', 216' in similar fashion.

To maintain the first and second parts 186, 188 operatively in place, a fastener 220 is provided. The fastener 220 consists of an enlarged head 222 and an elongate shank 224. The shank 224 is directed through a selected one of a plurality of bores/openings 226 extending through the part 186 and spaced at regular vertical intervals. The shank 224 extends through exemplary post opening 72*b* and into an aligned opening 228 in the base 198. The openings 228 in the base 198 are provided at regular vertical intervals to align with the bores 226.

The free end 230 of the shank 224 has a cross opening 232 to receive a conventional holding pin 234 that can be selectively installed and released by hand. The holding pin 234 prevents withdrawal of the shank 224.

To stabilize the connection of the parts 186, 188, the head 222 of the fastener 220 has a flat surface 236 with a large areal extent that bridges spaced edges 238, 240 defined by a concave, outer surface 242 on the first part 186.

The leg 202 has a beam connector 248, with the leg 200 having a like beam connector 248'. With this arrangement, a beam B can be supported upon each leg 200, 202.

Another significant feature of the beam support assembly 182 is that it is capable of supporting a beam with the beam support assembly 182 in either of two orientations turned 180° with respect to each other. This is made possible by the formation of the connectors 248, 248' with a symmetrical V shape, as seen clearly in FIG. 17. Walls 249, 249' defining stabilizing abutments for the beam end connectors 52, are provided above and below each beam connector 248, 248'.

The ability to invert the beam support assembly 182 allows incorporation of another spacing feature. As seen particularly in FIG. 19, the vertical center line CL for the connectors 248, 248' is offset from the center 250 of the centermost opening 228. Thus, if the beam support assembly 182 is inverted from the FIG. 19 orientation, and the center opening 228 is utilized, the connector center line CL is at a different height. Accordingly, with this arrangement, adjusting increments can be halved by inverting the beam support assembly 182. The opening locations can be selected based upon desired adjusting characteristics.

In all other respects, the beam support assembly 182 is usable as described for the beam support assembly 82 hereinabove.

The foregoing disclosure of specific embodiments is intended to be illustrative of the broad concepts comprehended by the invention.

The invention claimed is:

1. A shoring post comprising:

an elongate body having a lengthwise axis, a top and a bottom;

a first beam support assembly at one vertical location on the elongate body; and a second beam support assembly at a second vertical location on the elongate body, the second vertical location spaced along the lengthwise axis from the first vertical location, the first and second beam support assemblies configured to support separate, load bearing beams, wherein the second beam support assembly comprises joinable first and second parts that when joined in operative relationship captively engage the elongate body; and wherein there is a slot on one of the first and second parts and a tab on the other of the first and second parts, the tab and slot meshing with the first and second parts joined in operative relationship.

2. A shoring post comprising:

an elongate body having a lengthwise axis, a top and a bottom;

a first beam support assembly at one vertical location on the elongate body; and a second beam support assembly at a second vertical location on the elongate body, the second vertical location spaced along the lengthwise axis from the first vertical location, the first and second beam support assemblies configured to support separate, load bearing beams, wherein the second beam support assembly comprises joinable first and second parts that when joined in operative relationship captively engage the elongate body; and wherein the second beam support assembly comprises first and second connectors respectively for first and second connectors on separate beams to be operatively situated on the second beam support assembly, and the first and second connectors on the second beam support assembly are both on one of the first and second parts.

3. A shoring post comprising:

an elongate body having a lengthwise axis, a top and a bottom;

a first beam support assembly at one vertical location on the elongate body; and a second beam support assembly at a second vertical location on the elongate body, the second vertical location spaced along the lengthwise axis below the first vertical location, the first and second beam support assemblies configured to support separate, respective first and second load bearing beams, wherein the second beam support is configured to be removable from the elongate body when the elongate body supports the first load bearing beam with the first beam support.

4. The shoring post according to claim 3 in combination with a beam having a first connector and the second beam support assembly has a second connector to which the first connector is joined through a press fit step to operatively situate the beam.

5. The shoring post according to claim 3 wherein the second beam support assembly comprises joinable first and second parts that when joined in operative relationship captively engage the elongate body.

6. The shoring post according to claim 5 wherein the second beam support assembly comprises a connector for supporting a load bearing beam to be operatively situated on the second beam support assembly.

7. The shoring post according to claim 6 wherein the body has a first opening and the second beam support assembly further comprises a fastener that extends into the first opening and maintains the first and second parts in operative relationship.

8. The shoring post according to claim 7 wherein the first and second parts are selectively joinable in first and second different operative relationships with the fastener extended into the first opening, the first connector located at different locations along the lengthwise axis with the first and second parts joined in the first and second different operative relationships.

9. The shoring post according to claim 7 wherein there are separate meshing components on the first and second parts and the meshing components are configured to interconnect with the first and second parts in each of the first and second different operative relationships.

10. The shoring post according to claim 9 wherein the meshing components are configured to interconnect by relatively moving the first and second parts along a line transversely to the lengthwise axis of the body.

11. The shoring post according to claim 9 wherein the second beam support assembly further comprises a locking block with a first set of teeth and one of the first and second parts has a second set of teeth against which the first set of teeth is borne with the fastener tightened.

12. The shoring post according to claim 11 wherein the one of the first and second parts has a slot that is elongate along the lengthwise axis and the second set of teeth is provided adjacent the elongate slot and extends along the lengthwise axis.

13. The shoring post according to claim 12 wherein the elongate slot has spaced edges extending along the lengthwise axis and the second set of teeth is provided at and extends along the lengthwise axis at each of the spaced edges.

14. The shoring post according to claim 7 wherein the body has a plurality of openings including the first opening and the fastener can be extended selectively through each of the plurality of openings to maintain the first and second parts in operative relationship.

15. The shoring post according to claim 4 wherein the second beam support assembly comprises another connector like the second connector for a connector on another beam to be operatively situated on the second beam support assembly.

16. The shoring post according to claim 6 wherein the first beam support assembly comprises a plurality of connectors like the second connector.

17. The shoring post according to claim 3 wherein the elongate body comprises first and second parts that are slidably engaged with each other for relative repositioning along the lengthwise axis to thereby vary a length of the elongate body.

18. The shoring post according to claim 9 wherein the meshing components on each of the first and second parts comprise elongate substantially straight and parallel rails that are spaced along the lengthwise axis.

19. The shoring post according to claim 5 wherein the elongate body has a convex outer surface and the first and second parts each comprises a body with an inside surface with a curvature matched to the convex outer surface.

20. The shoring post according to claim 19 wherein the first and second parts cooperatively extend substantially fully around the convex outer surface.

21. The shoring post according to claim 3 in combination with a first beam operatively situated on the first beam support assembly and a second beam operatively situated on the second beam support assembly.

22. The shoring post according to claim 7 wherein the fastener is configured to be hand tightened without requiring any tools to maintain the first and second parts in the operative relationship.

23. The shoring post according to claim 5 wherein the second beam support assembly comprises first and second connectors respectively for first and second connectors on separate beams to be operatively situated on the second beam support assembly.

24. The shoring post according to claim 5 wherein there are a plurality of aligned openings in each of the first and second parts through which a fastener can be selectively directed to maintain the first and second parts joined in operative relationship.

25. The shoring post of claim 3, wherein the second beam support assembly comprises joinable first and second parts that when joined in operative relationship captively engage the elongate body, and a fastener that extends through both of the first and second parts and the elongate body.

* * * * *